US009358164B2

(12) United States Patent
Brenner et al.

(10) Patent No.: US 9,358,164 B2
(45) Date of Patent: Jun. 7, 2016

(54) EASILY DISSOCIABLE WHEELCHAIR

(71) Applicants: Simon Brenner, Basel (CH); Rainer Kuschall, Allschwil (CH)

(72) Inventors: Simon Brenner, Basel (CH); Rainer Kuschall, Allschwil (CH)

(73) Assignee: Invacare International Sarl, Gland (CH)

( * ) Notice: Subject to any disclaimer, the term of this patent is extended or adjusted under 35 U.S.C. 154(b) by 0 days.

(21) Appl. No.: 14/367,394

(22) PCT Filed: Dec. 21, 2012

(86) PCT No.: PCT/IB2012/057602

§ 371 (c)(1),
(2) Date: Jun. 20, 2014

(87) PCT Pub. No.: WO2013/093874

PCT Pub. Date: Jun. 27, 2013

(65) Prior Publication Data

US 2015/0048600 A1 Feb. 19, 2015

(30) Foreign Application Priority Data

Dec. 21, 2011 (EP) ..... 11194994

(51) Int. Cl.

| | |
|---|---|
| ***A61G 5/08*** | (2006.01) |
| ***A61G 5/10*** | (2006.01) |
| *A61G 5/12* | (2006.01) |

(52) U.S. Cl.

CPC *A61G 5/08* (2013.01); *A61G 5/107* (2013.01); *A61G 5/1059* (2013.01);

(Continued)

(58) Field of Classification Search

CPC ..... A61G 5/00; A61G 5/02; A61G 5/08; A61G 5/10; A61G 5/1056; A61G 5/1059; A61G 5/1062; A61G 5/1064; A61G 5/1067; A61G 5/1072; A61G 5/107; A61G 2005/0866; A61G 2005/0875; A61G 2005/0891; A61G 2005/1054; A61G 2005/1091; A61G 2005/128

USPC ..... 280/642, 643, 647, 648, 650, 657, 658, 280/47.38, 47.4

See application file for complete search history.

(56) References Cited

U.S. PATENT DOCUMENTS 4,529,247 A * 7/1985 Stumpf ..... A47C 3/026 297/285

(Continued)

FOREIGN PATENT DOCUMENTS

| | | | |
|---|---|---|---|
| DE | 29901471 | U1 | 7/1999 |
| DE | 1020100367 | A1 | 9/2011 |
| GB | 2238275 | A | 5/1991 |

OTHER PUBLICATIONS

International Search Report from International Application No. PCT/IB2012/057602, date of completion Apr. 2, 2013.

(Continued)

*Primary Examiner* — John Walters

(74) *Attorney, Agent, or Firm* — Calfee, Halter & Griswold LLP

(57) ABSTRACT

A wheelchair (10) comprising:—a seat module (10) including a seat frame (11) supporting a seat (12);—a backrest module (20) including a backrest frame (21) connected to said seat frame (11) and supporting a backrest (22);—a front frame module (30) including a front frame (31), said front frame (31) including left and right bended legs (31*a*, 31*b*) removably connected at their upper end to said seat frame (11) and at their lower end to a footrest (32), said bended legs (31*a*, 31*b*) being supported by caster wheel assemblies (35, 36) via caster support (34);—a rear wheel module (40) including left and right rear wheels (41*a*, 41*b*) pivotally connected to an axle (42), said rear wheel module (40) being removably connected to said seat module (10) through left and right connecting elements (43*a*, 43*b*); wherein said seat frame (11) consists in left and right longitudinal profiles (11*a*, 11*b*) extending in the same plane.

17 Claims, 6 Drawing Sheets

(52) U.S. Cl.
CPC ..... *A61G 2005/0866* (2013.01); *A61G 2005/0875* (2013.01); *A61G 2005/0891* (2013.01); *A61G 2005/1054* (2013.01); *A61G 2005/1091* (2013.01); *A61G 2005/128* (2013.01)

(56) References Cited

U.S. PATENT DOCUMENTS 4,592,570 A * 6/1986 Nassiri ..... A61G 5/00 280/250.1
5,421,598 A * 6/1995 Robertson ..... A61G 5/00 280/250.1
6,123,306 A * 9/2000 Jackson ..... B62J 11/00 248/187.1
6,311,999 B1 11/2001 Kueschall
6,416,070 B1 * 7/2002 Lin ..... A61G 5/10 280/250.1
6,464,243 B2 * 10/2002 Roche ..... A61G 5/08 280/250.1
7,520,518 B2 * 4/2009 Peterson ..... A61G 5/00 280/250.1
8,490,994 B2 * 7/2013 Knopf ..... A61G 5/02 280/250.1
2006/0087098 A1 4/2006 Peterson

OTHER PUBLICATIONS

Written Opinion from International Application No. PCT/IB2012/057602, date of mail Apr. 8, 2013.
International Preliminary Report of Patentability from International Application No. PCT/IB2012/057602, date of issuance Jun. 24, 2014.

* cited by examiner

EASILY DISSOCIABLE WHEELCHAIR

RELATED APPLICATIONS

The present application is the U.S. national phase entry of PCT/IB2012/057602, filed on Dec. 21, 2012 which claims priority to European patent application Ser. No. 11194994.7 filed on Dec. 21, 2011, the entire disclosures of which are fully incorporated herein by reference.

FIELD OF THE INVENTION

The present invention relates to a wheelchair that can be easily and quickly dissociated so as to permit it to be easily placed inside an automobile or other suitable conveyance.

The present invention relates also to a wheelchair having a modular structure that can be easily modified in accordance with the needs or wishes of the user. The present invention relates also to a wheelchair that can be step-less adjustable.

BACKGROUND OF THE INVENTION

The portability of a wheelchair is an important consideration to many wheelchair users. It is desirable that a wheelchair be lightweight and easily broken down so that it can be readily and conveniently transported in an automobile or other suitable conveyance. Most wheelchairs today are foldable which permits them to be placed in the trunk or behind the front seat of an automobile. These wheelchairs, however, are still unusually bulky and heavy and therefore, somewhat inconvenient to transport. An alternative to this problem consists in disassembling the wheelchair before placing it inside the automobile. However, most wheelchairs today have a complex structure which makes such a disassembling operation very difficult and very long to do. Furthermore, considering that the main frame of the wheelchair generally comprises both the seat frame and the bended legs on which is connected the caster wheels, the volume occupied by said wheelchair after said disassembling operation remains too high for an easy positioning of said disassembled wheelchair inside an automobile. In addition, with such a structure, the entire main frame has to be replaced when only the bended legs of said main frame are damaged. Thus, there is a need for a wheelchair avoiding the above-mentioned drawbacks.

There is also a need for a wheelchair that may be adjustable in a quick and easy way.

There is also a need for a wheelchair that may be adapted to the needs or the wishes of the user.

There is also a need for a wheelchair that permits the stepless adjustment of the rear wheels in a direction orthogonal to the seat plane.

There is also a need for a wheelchair in which the seat plate is integral with the seat frame.

There is also a need for a wheelchair in which the connection between the rear wheels and the seat is improved.

There is finally a need for a wheelchair in which the connection between the front wheels and the seat is improved.

SUMMARY OF THE INVENTION

According to a first embodiment of the invention, these aims are achieved by means of a wheelchair comprising:

- a seat module including a seat frame supporting a seat;
- a backrest module including a backrest frame connected to said seat frame and supporting a backrest;
- a front frame module including a front frame, said front frame including left and right bended legs removably connected at their upper end to said seat frame and at their lower end to a footrest, said bended legs being supported by caster wheel assemblies via caster support;
- a rear wheel module including left and right rear wheels pivotally connected to an axle, said rear wheel module being removably connected to said seat module through left and right connecting elements;

wherein said seat frame consists in left and right longitudinal profiles extending in the same plane.

Important features of the device are defined in the dependent claims 2 to 16.

According to a second embodiment of the invention, these aims are achieved by a means of a wheelchair comprising:

- a seat module including a seat frame supporting a seat;
- a backrest module including a backrest frame connected to said seat frame and supporting a backrest;
- a front frame module including a front frame, said front frame including left and right bended legs removably connected at their upper end to said seat frame and at their lower end to a footrest, said bended legs being supported by caster wheel assemblies via caster support;
- a rear wheel module including left and right rear wheels pivotally connected to an axle, said rear wheel module being removably connected to said seat module through left and right connecting elements;

wherein said seat frame consists in left and right longitudinal profiles extending in the same plane;

wherein said left and right connecting elements are configured so as to permit a step-less adjustment of the position of the rear wheel module with regard to the seat module in a direction orthogonal to the plane defined by the seat frame.

According to a third embodiment of the invention, these aims are achieved by a means of a wheelchair comprising:

- a seat module including a seat frame supporting a seat;
- a backrest module including a backrest frame connected to said seat frame and supporting a backrest;
- a front frame module including a front frame, said front frame including left and right bended legs removably connected at their upper end to said seat frame and at their lower end to a footrest, said bended legs being supported by caster wheel assemblies via caster support;
- a rear wheel module including left and right rear wheels pivotally connected to an axle, said rear wheel module being removably connected to said seat module through left and right connecting elements;

wherein said seat frame consists in left and right longitudinal profiles extending in the same plane;

wherein the seat comprises a seat plate extending between the left and right profiles of the seat frame, said seat plate being integral with said left and right profiles;

wherein, preferably, said seat plate is made in a rigid material;

wherein, preferably, said rigid material is a carbon fiber material;

wherein, preferably, said seat plate is provided with parallel slots extending from the rear end of said seat plate in a rear-to-front direction so as to define a plurality of flexible areas in a rear part of said seat plate.

According to a fourth embodiment of the invention, these aims are achieved by a means of a wheelchair comprising:

- a seat module including a seat frame supporting a seat;
- a backrest module including a backrest frame connected to said seat frame and supporting a backrest;
- a front frame module including a front frame, said front frame including left and right bended legs removably connected at their upper end to said seat frame and at their lower end to a footrest, said bended legs being supported by caster wheel assemblies via caster support;

a rear wheel module including left and right rear wheels pivotally connected to an axle, said rear wheel module being removably connected to said seat module through left and right connecting elements;

wherein said seat frame consists in left and right longitudinal profiles extending in the same plane;

wherein said left, respectively said right, connecting element comprises a tubular element extending in a direction approximately orthogonal to the plane defined by the seat frame, a first securing arrangement positioned at the upper end of said tubular element, said first securing arrangement allowing said tubular element to be fixed with respect to the left, respectively the right, profile of the seat frame, and a second securing arrangement positioned along said tubular element, said second securing arrangement allowing said tubular element to be fixed with respect to the axle of the rear wheel module;

wherein said first, respectively said second, securing arrangement comprises a nut, a screw and a mounting piece, said screw being adapted to slide inside a slot provided in the seat frame, respectively in the tubular element of the left or right connecting element, said screw being also adapted to be inserted through a hole provided in said mounting piece and to sit in a threaded hole provided in said nut;

wherein, preferably, the nut of the first securing arrangement has approximately the form of a trapezoidal prism, the non-parallel lateral sides of said nut abutting against two converging flanges downwardly extending from the periphery of the left, respectively the right, profile of the seat frame when the left, respectively the right, connecting element is fixed on said left, respectively said right, profile, the free ends of said flanges defining the slot inside which slides the screw of said first securing arrangement;

wherein, preferably, the mounting piece of the first securing arrangement comprises a U-shape element extending in a rear-to-front direction, the lateral flanges of said U-shape element abutting against the flanges downwardly extending from the periphery of the left, respectively the right, profile of the seat frame when the left, respectively the right, connecting element is fixed on said left, respectively said right, profile;

wherein, preferably, the nut of the second securing arrangement has approximately the form of a trapezoidal prism, the non-parallel lateral sides of said nut abutting against two converging flanges rearwardly or forwardly extending at the periphery of the tubular element when the left or the right connecting element is fixed on the axle of the rear wheel module, the free ends of said flanges defining the slot inside which slides the screw of said second securing arrangement;

wherein, preferably, the mounting piece of the second securing arrangement comprises a cylindrical split ring having forwardly, respectively rearwardly, extending U-shape portion, said split ring having a cylindrical aperture extending in a left-to-right direction, said aperture being adapted to receive the axle of the rear wheel module, said U-shape portion extending in a direction approximately orthogonal to the plane defined by the seat frame (11), the lateral flanges of said U-shape portion abutting against the flanges rearwardly, respectively forwardly, extending at the periphery of the tubular element when the left or the right connecting element is fixed on the axle of the rear wheel module.

According to a fifth embodiment of the invention, these aims are achieved by a means of a wheelchair comprising:

a seat module including a seat frame supporting a seat;

a backrest module including a backrest frame connected to said seat frame and supporting a backrest;

a front frame module including a front frame, said front frame including left and right bended legs removably connected at their upper end to said seat frame and at their lower end to a footrest, said bended legs being supported by caster wheel assemblies via caster support;

a rear wheel module including left and right rear wheels pivotally connected to an axle, said rear wheel module being removably connected to said seat module through left and right connecting elements;

wherein said seat frame consists in left and right longitudinal profiles extending in the same plane;

wherein the left, respectively the right, bended leg of the front frame module telescopically extends into the left, respectively the right, profile of the seat frame and includes at least one pair of bores for registering with a plurality of pair of holes provided along said left, respectively said right, profile, said bores and said holes being adapted to receive the shank of a screw.

With such an arrangement, the wheelchair may be easily dissociated or adapted to the needs of the user.

In particular, each module can be easily replaced or changed when they are damaged or do not correspond to the needs or whishes of the user.

Moreover, the connection means between the seat module and the other modules enable step-less adjustment of the position of the seat in a rear-to-front direction and/or in a bottom-to-top direction.

BRIEF DESCRIPTION OF THE DRAWINGS

The invention will be better understood with the aid of the description of an embodiment given by way of example and illustrated by the figures, in which.

DETAILED DESCRIPTION OF THE INVENTION

The present invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

For the purpose of the present specification, situations and directions of elements of the wheelchair are determined by the perspective of a user seated in the wheelchair. Accordingly, the left side of the wheelchair corresponds to the right side of FIG. 1 and vice versa. The situations or directions "up" or "top" and "down" or "bottom", "rear" or "back" and "front", "behind" and "in front", "distal" and "proximal", "lateral" and "central" follow the same rule. The term "longitudinal" indicates a direction of an element, such as a tube, having, as a major direction component, the rear-to-front direction. Such an element may also to some or to a minor extent be skewed laterally and/or towards the bottom or the top. The terms "forward" or "forwardly" and "rearward" or "rearwardly" refer to the direction of motion of the wheelchair. The term "horizontal" refers to a plane parallel to the plane defined by the seat frame when the wheelchair stands on a horizontal plane and the term "vertical" refers to a plane orthogonal to a horizontal plane. Said terminology will include the words specifically mentioned, derivatives thereof, and words of similar import.

Figure 1:
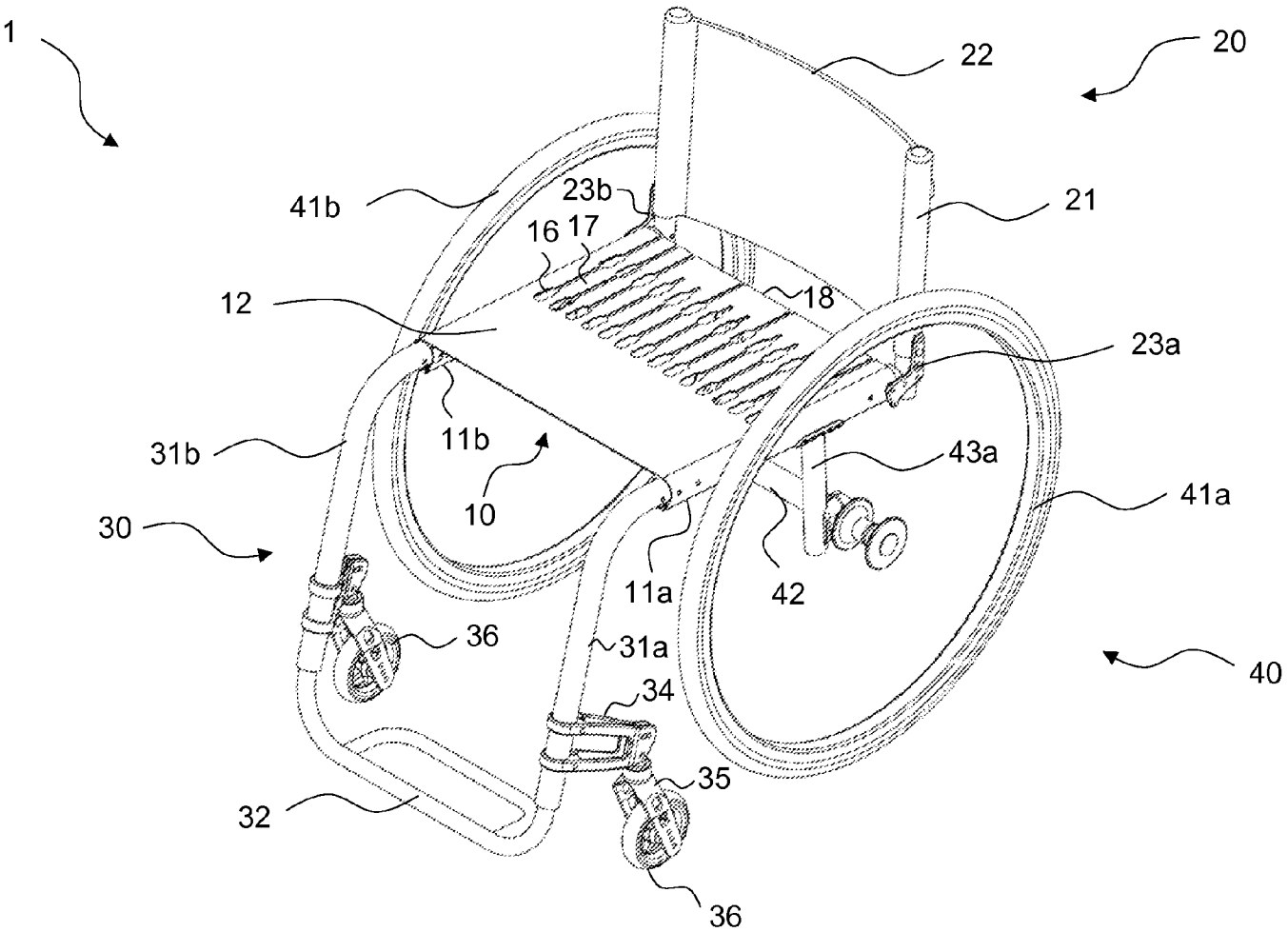
FIG. 1 illustrates a front perspective view of a wheelchair according to an embodiment of the invention.
Figure 2:
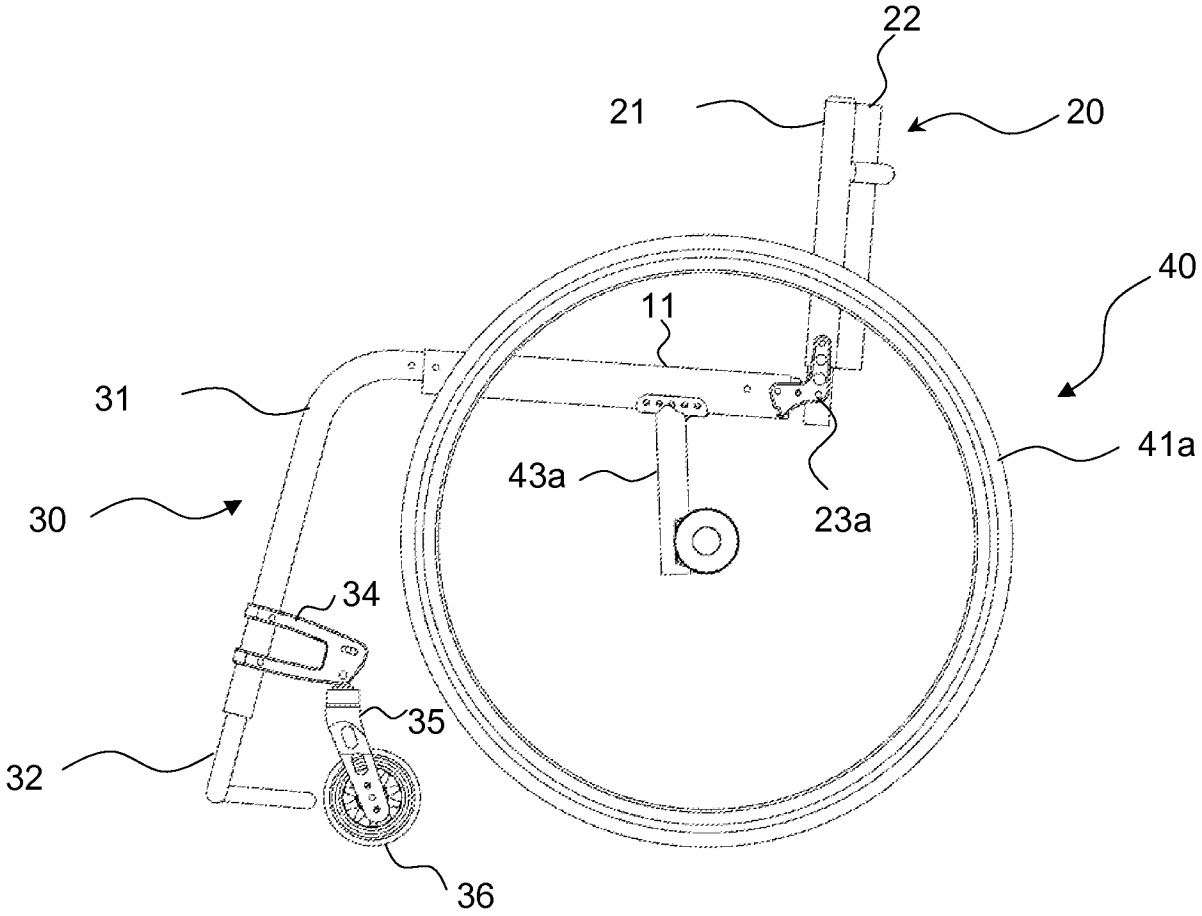
FIG. 2 is a side view of the wheelchair of FIG. 1.

Referring to FIGS. 1 and 2, a wheelchair according to the invention is illustrated. The wheelchair 1 comprises four independent modules, a seat module 10, a backrest module 20, a front frame module 30 and a rear wheel module 40, that may be easily adjusted or separated.

Figure 3:
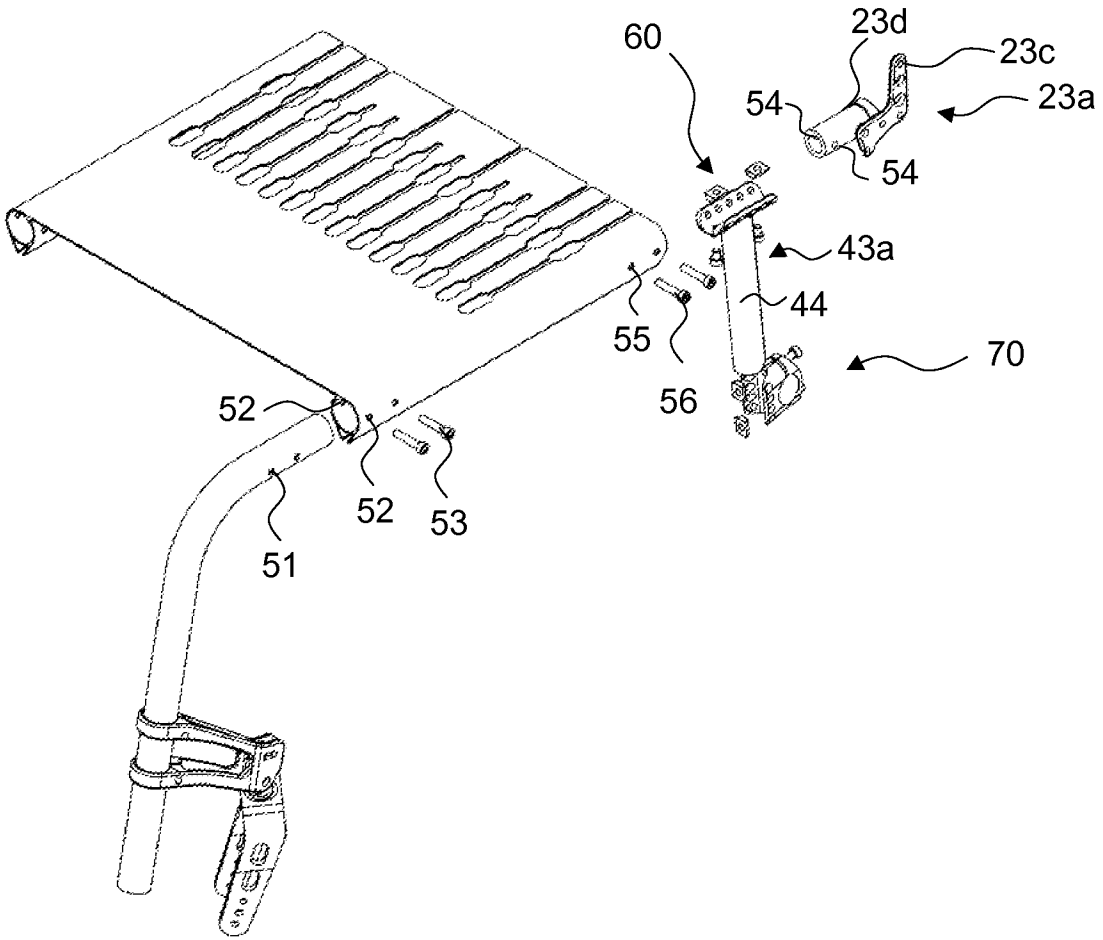
FIG. 3 is a front perspective exploded view of the wheelchair of FIG. 1, showing the different connection means used for connecting the backrest, front frame and rear wheel modules of the wheelchair to the left profile of the seat module.
Figure 4:
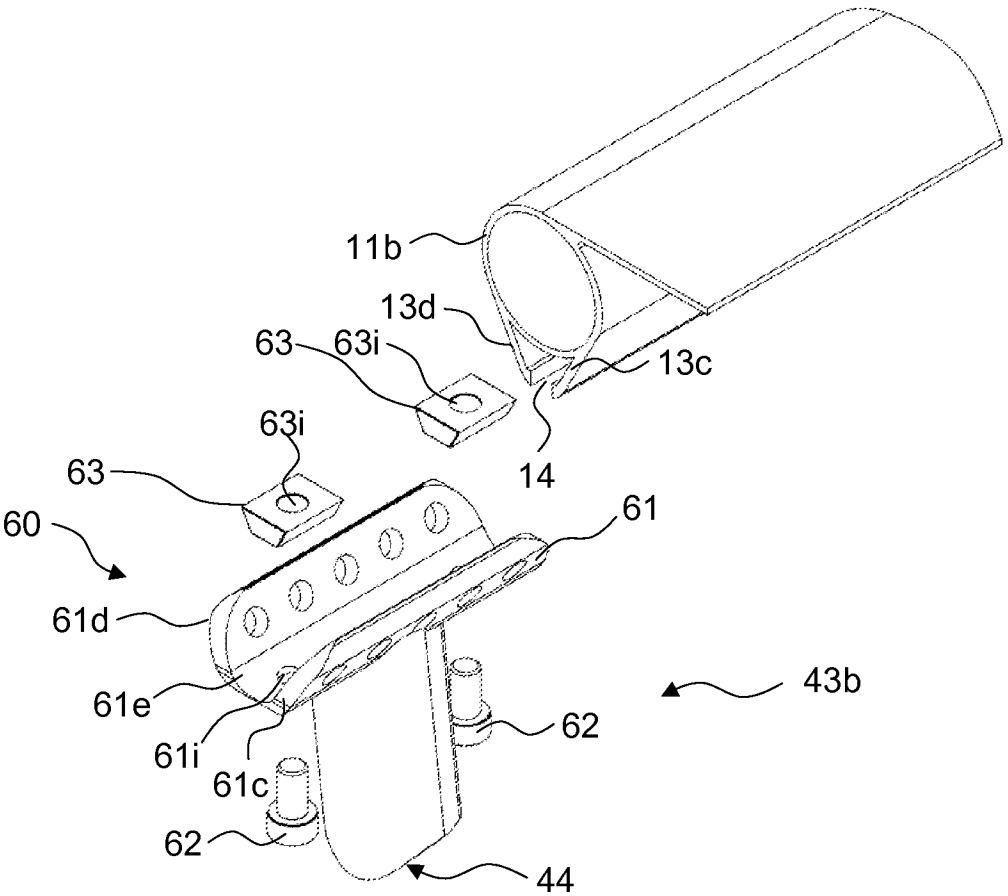
FIG. 4 is a front perspective exploded view of the wheelchair of FIG. 1, showing in greater detail the upper part of the right connecting element used for connecting the rear wheel module to the seat module.
Figure 5:
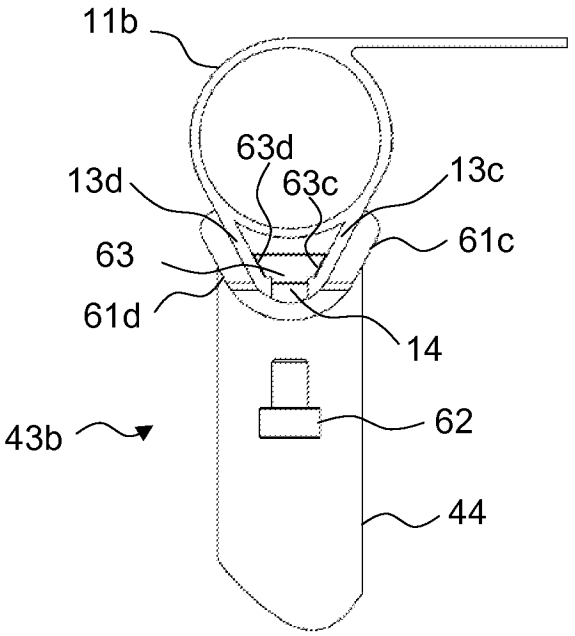
FIG. 5 is a front view of the wheelchair of FIG. 1, showing in greater detail the upper part of the right connecting element used for connecting the rear wheel module to the seat module.

The seat module 10 comprises a seat frame 11 supporting a seat plate 12 and the backrest module 20 comprises a backrest frame 21 supporting a backrest plate 22. The seat frame 11 consists in left and right longitudinal profiles 11*a* and 11*b*, said profiles consisting in the embodiment shown in hollow tubes extending in a substantially parallel rear-to-front direction. Thus, said profiles 11*a*, 11*b* extend in the same plane. In a further embodiment of the present invention, the axes of the profiles 11*a*, 11*b* may also extend in the same plane without defining the same direction. The cross section of said profiles 11*a*, 11*b* may define a circular form as in the embodiment shown in FIG. 1, or other forms, such as an ellipse, a rectangle, a square, a U-shape or I-shape form. The backrest module 20 is connected to the seat module 10 via left and right angle linking elements 23*a* and 23*b*. As shown in detail in FIG. 3, each linking element 23*a*, 23*b* comprises an L-shape bracket 23*c* fixedly connected to a tail plug 23*d* along its horizontal portion and to the backrest frame 21 along its vertical portion, said tail plug 23*d* being configured to telescopically extend into the left or the right profile 11*a*, 11*b*. In the embodiment illustrated in FIG. 3, the tail plug 23*d* is fixedly connected to the left profile 11*a* via screws 56 adapted to be received inside bores 54, 55 of the tail plug 23*d* and the left profile 11*a* respectively. In a further embodiment of the invention, the linking elements 23*a* and 23*b* may be configured so as to pivotally connect the backrest module 20 to the seat module 10. The seat plate 12 extends between the left and right profiles 11*a*, 11*b*. In the embodiment illustrated in FIG. 1, said seat plate 12 is integral with said left and right profiles 11*a*, 11*b*. Such a configuration improves the rigidity of the seat frame 11, and thus, the rigidity of the wheelchair as a whole. Furthermore, such a configuration reduces the volume occupied by and the weight of conventional seats in which the seat is generally a bulky and heavy structure. Finally, such a configuration reduces the number of processing steps for making such a seat. Indeed, no fixing means is necessary for connecting the seat plate 12 to the seat frame 11. The seat plate 12 may advantageously be made in a rigid material, and preferably in the same material as the left and right profiles 11*a* and 11*b*. Said rigid material may advantageously be a lightweight material, such as a carbon fiber material. To improve the comfort of the wheelchair for the user, this rigid seat plate 12 is provided with parallel slots 16 extending from the rear end 18 of said seat plate 12 in a rear-to-front direction so as to define a plurality of flexible areas 17 in a rear part of said seat plate 12. In a further embodiment of the present invention, a cushion may be attached to the upper side of the seat plate 12, said cushion improving the comfort of the wheelchair. As shown in detail on FIGS. 4 and 5, the left and right profiles 11*a* and 11*b* are provided with two converging flanges 13*c* and 13*d* downwardly extending from the circular periphery of said profiles 11*a*, 11*b*. The role of said flanges 13*c* and 13*d* will be explained in the following paragraphs.

The front frame module 30 comprises a front frame 31 including left and right bended legs 31*a* and 31*b*, said legs being removably connected at their upper end to the left and right profiles 11*a* and 11*b* respectively and at their lower end to a footrest 32. Each bended leg 31*a*, 31*b* is supported by a caster wheel assembly via a caster support 34. Said caster wheel assembly consists in a caster fork 35 supporting a caster wheel 36. As shown in detail on FIG. 3, each bended leg 31*a*, 31*b* consists in a hollow tube telescopically extending into the left or right profiles 11*a*, 11*b*. Each bended leg 31*a*, 31*b* include at least one pair of bores 51 defining a left-to-right direction, said bores 51 being registered with a pair of holes 52 provided along the left or the right profile 11*a*, 11*b* when the legs 31*a*, 31*b* are connected to the profiles 11*a*, 11*b*. Said bores 51 and said holes 52 are configured to receive the shank of a screw 53 so as to removably connect the legs 31*a*, 31*b* to the profiles 11*a*, 11*b*. In a further embodiment of the invention, said legs 31*a*, 31*b* may be connected to said profiles 11*a*, 11*b* via a quick release mechanism. Such a quick release mechanism is known per se.

Figure 6:
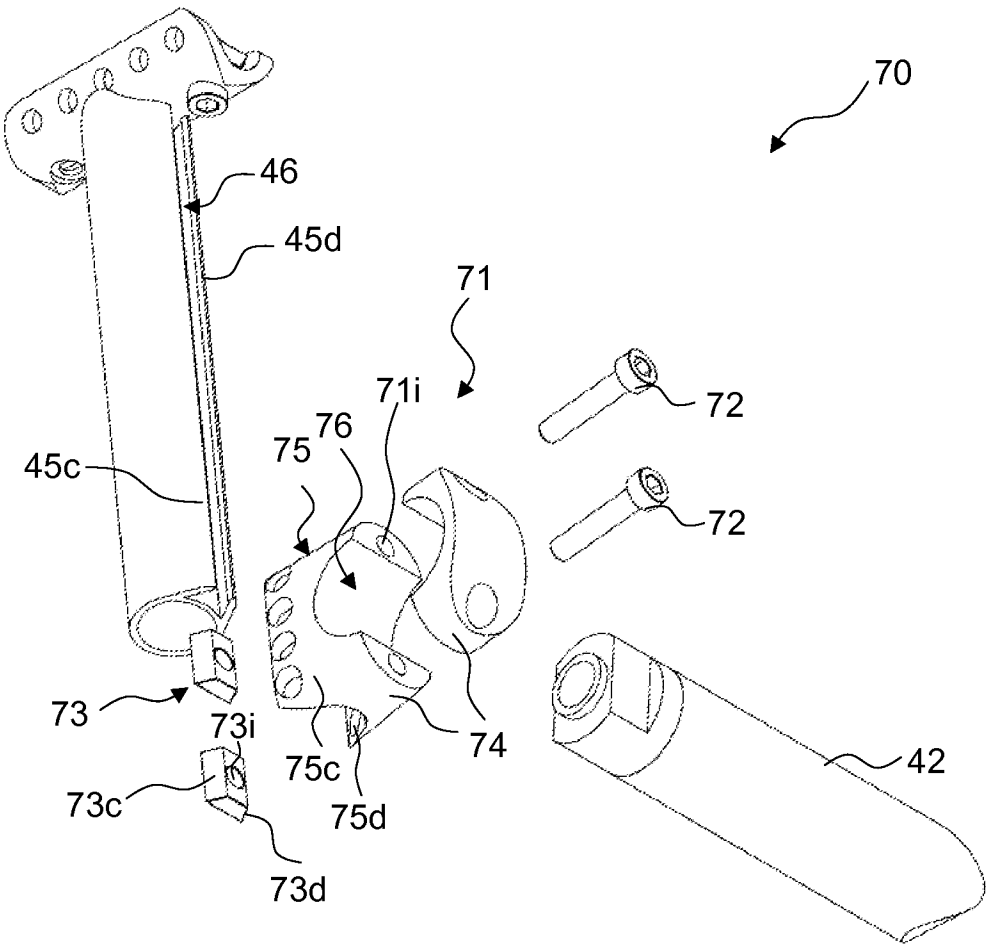
FIG. 6 is a rear perspective exploded view of the wheelchair of FIG. 1, showing in greater detail the lower part of the left connecting element used for connecting the rear wheel module to the seat module.

The rear wheel module 40 comprises left and right rear wheels 41*a*, 41*b* pivotally connected to an axle 42, said axle 42 being removably connected to the seat frame 21 through left and right connecting elements 43*a* and 43*b*. Said left and right connecting elements 43*a*, 43*b* are configured so as to permit a step-less adjustment of the position of the axle 42 with regard to the seat frame 11 in a rear-to-front direction and in a bottom-to-top direction. As shown in detail on FIG. 3, said left, respectively said right, connecting element 43*a*, 43*b* comprises a tubular element 44 extending in a direction approximately orthogonal to the plane defined by the seat frame 11, a first securing arrangement 60 positioned at the upper end of said tubular element 44 to be fixed with respect to the left, respectively the right, profile 11*a*, 11*b* and a second securing arrangement 70 positioned along said tubular element 44, said second securing arrangement 70 allowing said tubular element 44 to be fixed with respect to the axle 42. The cross section of tubular element 44 may define the same or a similar form as the cross section of the left or right profile 11*a*, 11*b*. Thus, as shown in detail on FIGS. 4 and 6, two converging flanges 13*c* and 13*d* downwardly extend from the periphery of the left or right profile 11*a* or 11*b* and two converging flanges 45*c* and 45*d* rearwardly extend at the periphery of the tubular element 44. The free ends of said flanges 13*c* and 13*d*, respectively 45*c* and 45*d*, are configured to define a slot 14, respectively a slot 46, extending in a rear-to-front direction, respectively a bottom-to-top direction. The slot 14, respectively 46, is configured to permit the sliding movement of two screws 62, respectively two screws 72, along said rear-to-front direction, respectively said bottom-to-top direction. Each of said screws 62, respectively 72, cooperates with two nuts 63, respectively two nuts 73, and a mounting piece 61, respectively a mounting piece 71, to define the first securing arrangement 60, respectively the second securing arrangement 70. In particular, each nut 63, respectively 73, of the first, respectively the second, securing arrangement 60, respectively 70, has approximately the form of a trapezoidal prism, the non-parallel lateral sides 63*c*, 63*d*, respectively 73*c*, 73*d*, of said nut 63, respectively 73, abutting against the flanges 13*c*, 13*d*, respectively 45*c*, 45*d*, when the left or right connecting element 43*a*, 43*b* is fixed on the left or right profile 11*a*, 11*b*, respectively on the axle 42. The fixation of the left or right connecting element 43*a*, 43*b* on the left or right profile 11*a*, 11*b*, respectively on the axle 42, occurs when each screw 62, respectively 72, is inserted through a hole 61*i*, respectively a hole 71*i*, provided in the mounting piece 61, respectively 71, and sits in a threaded hole 63*i*, respectively a threaded hole 73*i*, provided in a nut 63, respectively 73. In a further embodiment of the invention, the first, respectively the second, securing arrangement 60, respectively 70, may comprise only one screw cooperating with only one nut so as to removably connect the left or right connecting element 43*a*, 43*b* to the left or right profile 11*a*, 11*b*, respectively to the axle 42. In a further embodiment of the invention, the nuts 63 or 73, the mounting piece 61 or 71 and the flanges 13*c*, 13*d* or 45*c*, 45*d* may have other alternative forms, such alternative forms being configured so that the flanges 13*c*, 13*d* or 45*c*, 45*d* are sandwiched between the lateral sides 63*c*, 63*d* or 73*c*, 73*d* of said nuts and the lateral flanges 61*c*, 61*d* or 75*c*, 75*d* of said mounting piece when the left or right connecting element 43*a*, 43*b* are fixed on the left or right profile 11*a*, 11*b* or on the axle 42. As shown in detail on FIGS. 4 and 5, the mounting piece 61 consists in a U-shape element extending in a rear-to-front direction, a central portion of the bottom flange 61*e* and a lower portion of the lateral flanges 61*c*, 61*d* of said U-shape element 61 extending upwardly from the upper end of the tubular element 44 and being integral therewith. The lateral flanges 61*c*, 61*d* of said U-shape element 61 abut against the flanges 13*c* and 13*d* of the left or right profile 11*a*, 11*b* when the left or right connecting element 43*a*, 43*b* is fixed on said left or right profile 11*a*, 11*b*. As shown in detail on FIG. 6, the mounting piece 71 comprises a cylindrical split ring 74 having forwardly extending U-shape portion 75. Said split ring 74 has a cylindrical aperture 76 extending in a left-to-right direction, said aperture being adapted to receive the axle 42. Said U-shape portion 75 extends in a bottom-to-top direction, the lateral flanges 75*c*, 75*d* abutting against the flanges 45*c* and 45*d* when the left or right connecting element 43*a*, 43*b* is fixed on the axle 42. In a further embodiment of the invention, the U-shape portion 75 may rearwardly extend from the cylindrical split ring 74. In this case, the flanges 45*c* and 45*d* forwardly extend at the periphery of the tubular element 44.

The above detailed description with reference to the drawings illustrates rather than limit the invention. There are numerous alternatives, which fall within the scope of the appended claims.

The invention claimed is:

1. A wheelchair comprising:

a seat module including a seat frame supporting a seat;

a backrest module including a backrest frame connected to said seat frame and supporting a backrest;

a front frame module including a front frame, said front frame including left and right bended legs removably connected at the upper end thereof to said seat frame and at the lower end thereof to a footrest, said bended legs being supported by caster wheel assemblies via caster support;

a rear wheel module including left and right rear wheels pivotally connected to an axle, said rear wheel module being removably connected to said seat module through left and right connecting elements;

wherein said seat frame comprises left and right longitudinal profiles extending in a same plane;

wherein each of said left and right connecting elements comprises a tubular element extending in a direction approximately orthogonal to the plane defined by the seat frame, a first securing arrangement positioned at the upper end of said tubular element, said first securing arrangement allowing said tubular element to be fixed with respect to the left and right profiles of the seat frame, and a second securing arrangement positioned along said tubular element, said second securing arrangement allowing said tubular element to be fixed with respect to the axle of the rear wheel module;

wherein each of said first and second securing arrangements comprises a nut, a screw and a mounting piece, said screw being adapted to slide inside a slot provided in the seat frame, respectively in the tubular element of the left or right connecting element, said screw being also adapted to be inserted through a hole provided in said mounting piece and to sit in a threaded hole provided in said nut.

2. The wheelchair according to claim 1, wherein said left and right connecting elements are configured so as to permit a step-less adjustment of the position of the rear wheel module with regard to the seat module in a rear-to-front direction.

3. The wheelchair according to claim 1, wherein said left and right connecting elements are configured so as to permit a step-less adjustment of the position of the rear wheel module with regard to the seat module in a direction orthogonal to the plane defined by the left and right longitudinal profiles of the seat frame.

4. The wheelchair according to claim 1, wherein the seat comprises a seat plate extending between the left and right profiles of the seat frame, said seat plate being integral with said left and right profiles.

5. The wheelchair according to claim 4, wherein said seat plate is made in a rigid material.

6. The wheelchair according to claim 5, wherein said rigid material is a carbon fiber material.

7. The wheelchair according to claim 4, wherein said seat plate is provided with parallel slots extending from a rear end of said seat plate in a rear-to-front direction so as to define a plurality of flexible areas in a rear part of said seat plate.

8. The wheelchair according to claim 1, wherein the nut of the first securing arrangement has approximately the form of a trapezoidal prism, the non-parallel lateral sides of said nut abutting against two converging flanges downwardly extending from the periphery of the left and right profiles of the seat frame when the left and right connecting elements are fixed on said left and right profiles, the free ends of said flanges defining the slot inside which slides the screw of said first securing arrangement.

9. The wheelchair according to claim 8, wherein the mounting piece of the first securing arrangement comprises a U-shape element extending in a rear-to-front direction, the lateral flanges of said U-shape element abutting against the flanges downwardly extending from the periphery of the left and right profiles of the seat frame when the left and right connecting elements are fixed on said left and right profiles.

10. The wheelchair according to claim 1, wherein the nut of the second securing arrangement has approximately the form of a trapezoidal prism, the non-parallel lateral sides of said nut abutting against two converging flanges rearwardly or forwardly extending at the periphery of the tubular element when the left or the right connecting element is fixed on the axle of the rear wheel module, the free ends of said flanges defining the slot inside which slides the screw of said second securing arrangement.

11. The wheelchair according to claim 10, wherein the mounting piece of the second securing arrangement comprises a cylindrical split ring having forwardly or rearwardly extending U-shape portion, said split ring having a cylindrical aperture extending in a left-to-right direction, said aperture being adapted to receive the axle of the rear wheel module, said U-shape portion extending in a direction approximately orthogonal to the plane defined by the seat frame, the lateral flanges of said U-shape portion abutting against the flanges rearwardiy or forwardly extending at the periphery of the tubular element when the left or the right connecting element is fixed on the axle of the rear wheel module.

12. The wheelchair according to claim 1, wherein the left and right bended legs of the front frame module telescopically extend into the left and right profiles of the seat frame and include at least one pair of bores for registering with a plurality of pair of holes provided along said left and right profiles, said bores and said holes being adapted to receive the shank of a screw.

13. The wheelchair according to claim 1, wherein the backrest frame is pivotally connected to the seat frame.

14. The wheelchair according to claim 1, wherein the cross section of said left and right profiles define at least one of a circle, an ellipse, a rectangle, a square, a U-shape form and an I-shape form.

15. A wheelchair comprising:

a seat module including a seat frame supporting a seat;

a backrest module including a backrest frame connected to said seat frame and supporting a backrest;

a front frame module including a front frame, said front frame including left and right banded legs removably connected at the upper end thereof to said seat frame and at the lower end thereof to a footrest, said bended legs being supported by caster wheel assemblies via caster support;

a rear wheel module including left and right rear wheels pivotally connected to an axle, said rear wheel module being removably connected to said seat module through left and right connecting elements;

wherein said seat frame comprises left and right longitudinal profiles extending in a same plane;

wherein the seat comprises a seat plate extending between the left and right profiles of the seat frame, said seat plate being integral with said left and right profiles;

wherein said seat plate is provided with parallel slots extending from a rear end of said seat plate in a rear-to-front direction so as to define a plurality of flexible areas in a rear part of said seat plate.

16. The wheelchair according to claim 15, wherein said seat plate is made in a rigid material.

17. The wheelchair according to claim 16, wherein said rigid material is a carbon fiber material.

* * * * *